US008068282B1

(12) United States Patent
Kastner et al.

(10) Patent No.: US 8,068,282 B1
(45) Date of Patent: Nov. 29, 2011

(54) SOLAR-POWERED LIGHT DAMPER FOR TUBULAR SKYLIGHT

(75) Inventors: Steve R. Kastner, Greenwood, SC (US); David C. Burrell, Greenwood, SC (US)

(73) Assignee: VKR Holding A/S, Hoersholm (DK)

( * ) Notice: Subject to any disclaimer, the term of this patent is extended or adjusted under 35 U.S.C. 154(b) by 0 days.

(21) Appl. No.: 13/014,512

(22) Filed: Jan. 26, 2011

(51) Int. Cl.
*G02B 17/00* (2006.01)

(52) U.S. Cl. ..... 359/591

(58) Field of Classification Search ..... 359/591, 359/596, 597; 52/200; 362/1
See application file for complete search history.

(56) References Cited

U.S. PATENT DOCUMENTS 4,072,404 A * 2/1978 Brown ..... 359/461
4,126,379 A * 11/1978 Wu ..... 359/597
5,675,487 A * 10/1997 Patterson et al. ..... 359/596
6,130,781 A * 10/2000 Gauvin ..... 359/591
6,918,216 B2 * 7/2005 Hoy et al. ..... 52/200
7,082,726 B2 * 8/2006 Prenn et al. ..... 52/200
2004/0100698 A1 * 5/2004 Aoki et al. ..... 359/591

FOREIGN PATENT DOCUMENTS

GB 2463635 A 3/2010

* cited by examiner

*Primary Examiner* — Christopher Mahoney
(74) *Attorney, Agent, or Firm* — TurnerPadgetGraham& Laney

(57) ABSTRACT

A tubular skylight is provided with a solar-powered light damper unit that includes a damper supported by an axle within a light-conveying tube, a solar cell, and a motor powered by the solar cell. The motor includes a cam that connects to the axle and that rotates the damper between a fully open position and a fully closed position. The solar cell is housed protectively within the skylight assembly, and may be attached to one of the damper itself or an interior surface of the light-conveying structure. The damper unit may be operated by remote control. The unit may be provided with new skylight installations or may be sold separately for retrofitting existing installations.

21 Claims, 8 Drawing Sheets

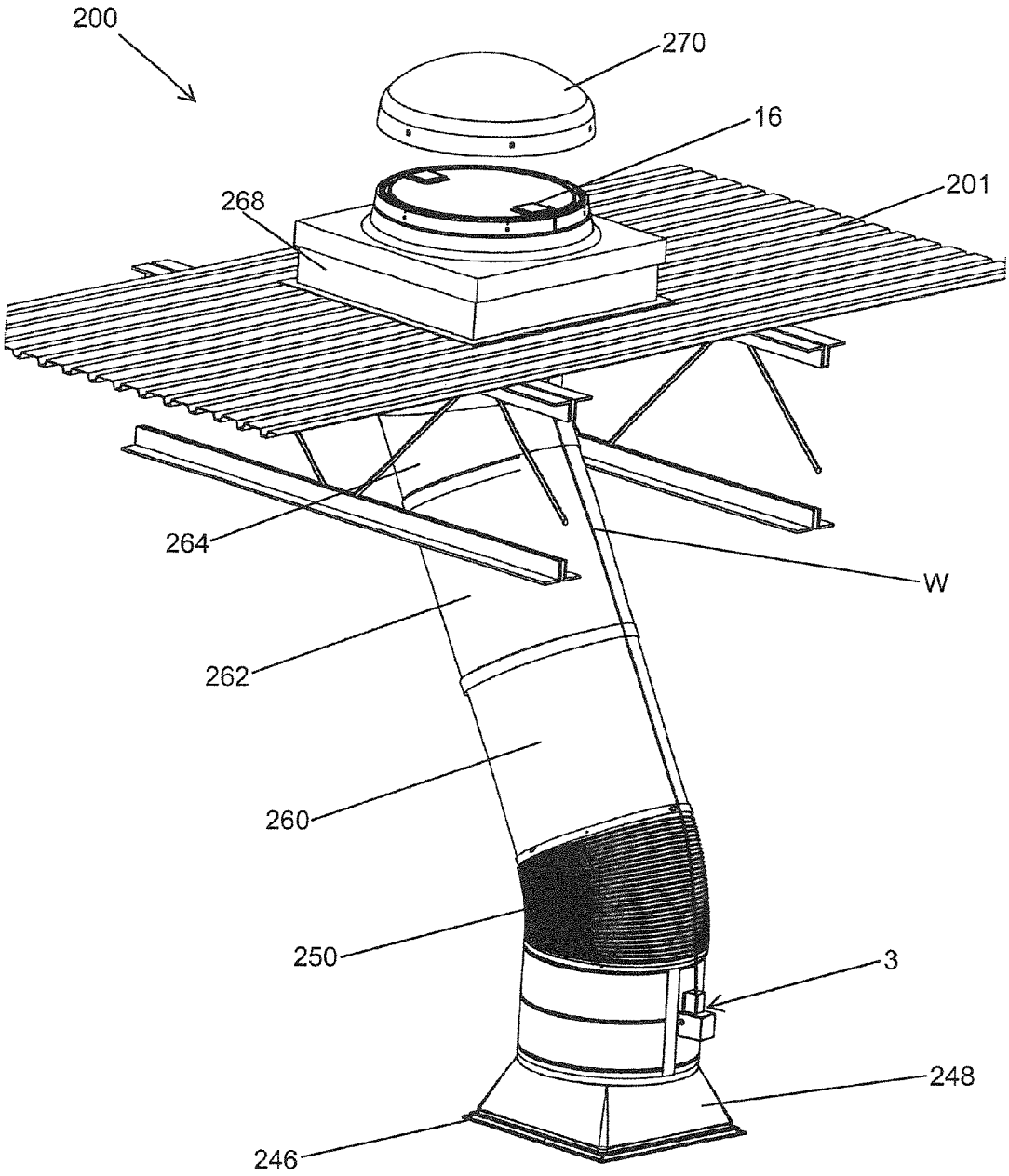
- FIG. 1A -

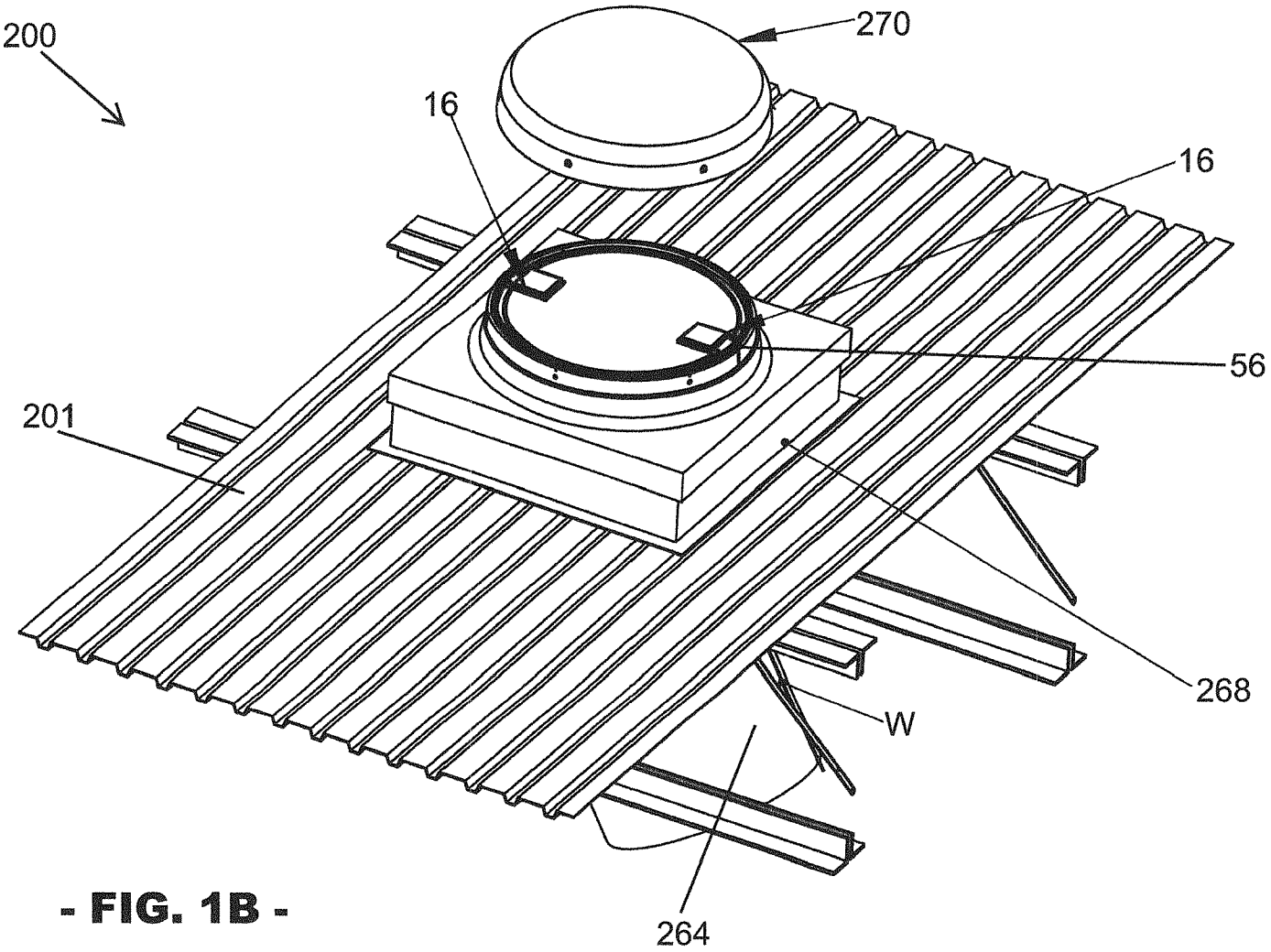
- FIG. 1B -

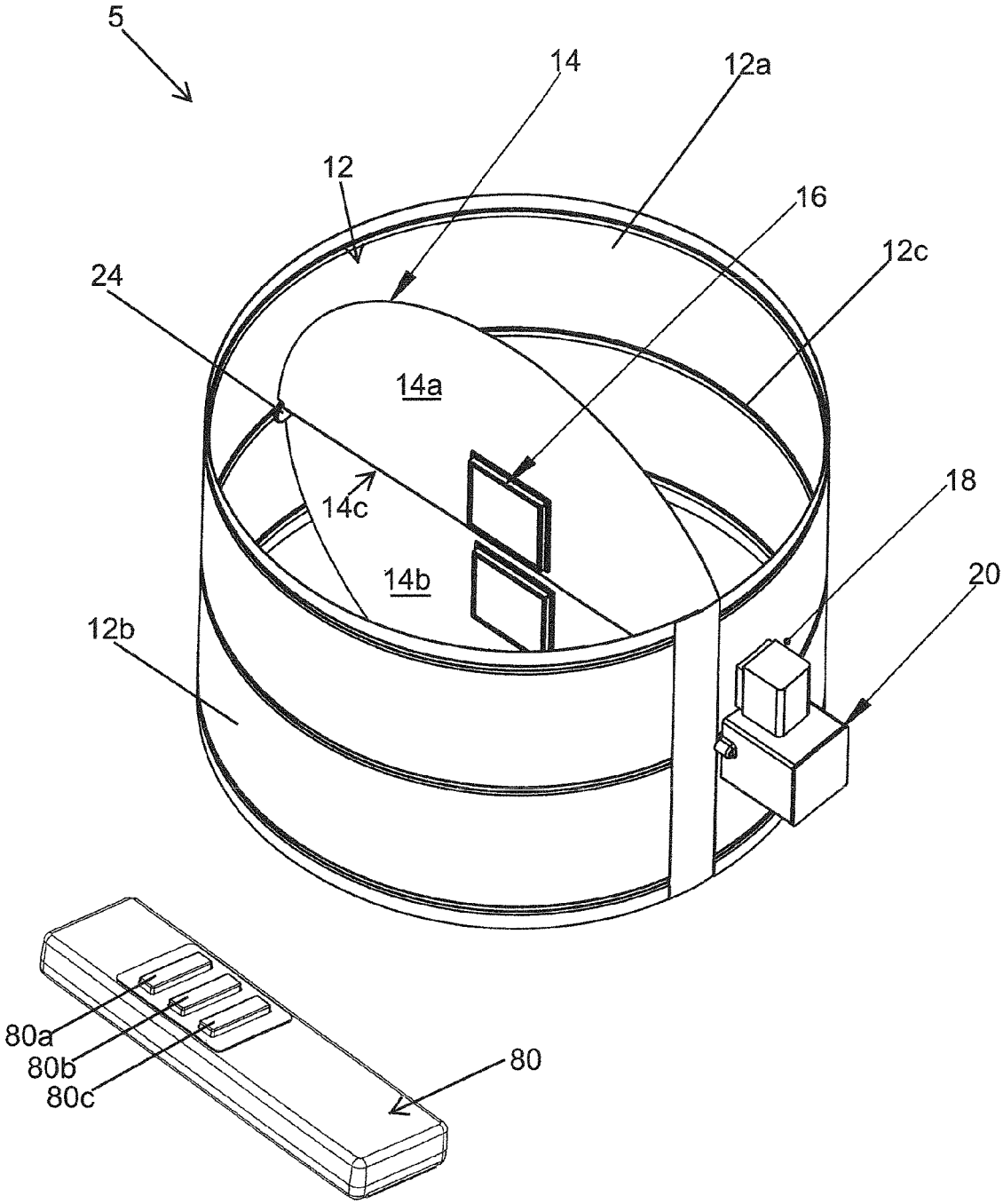
- FIG. 2A -

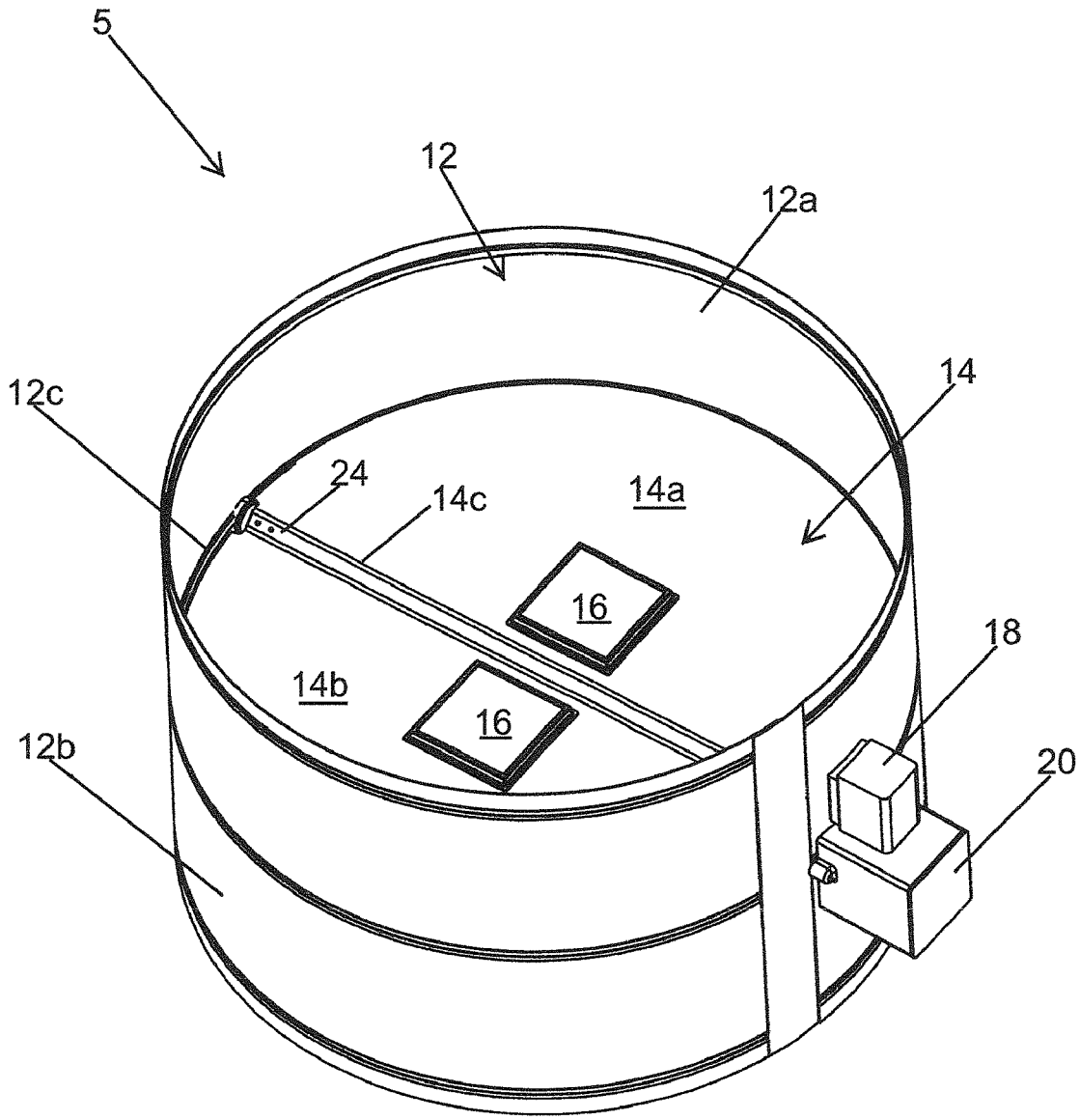
- FIG. 2B -

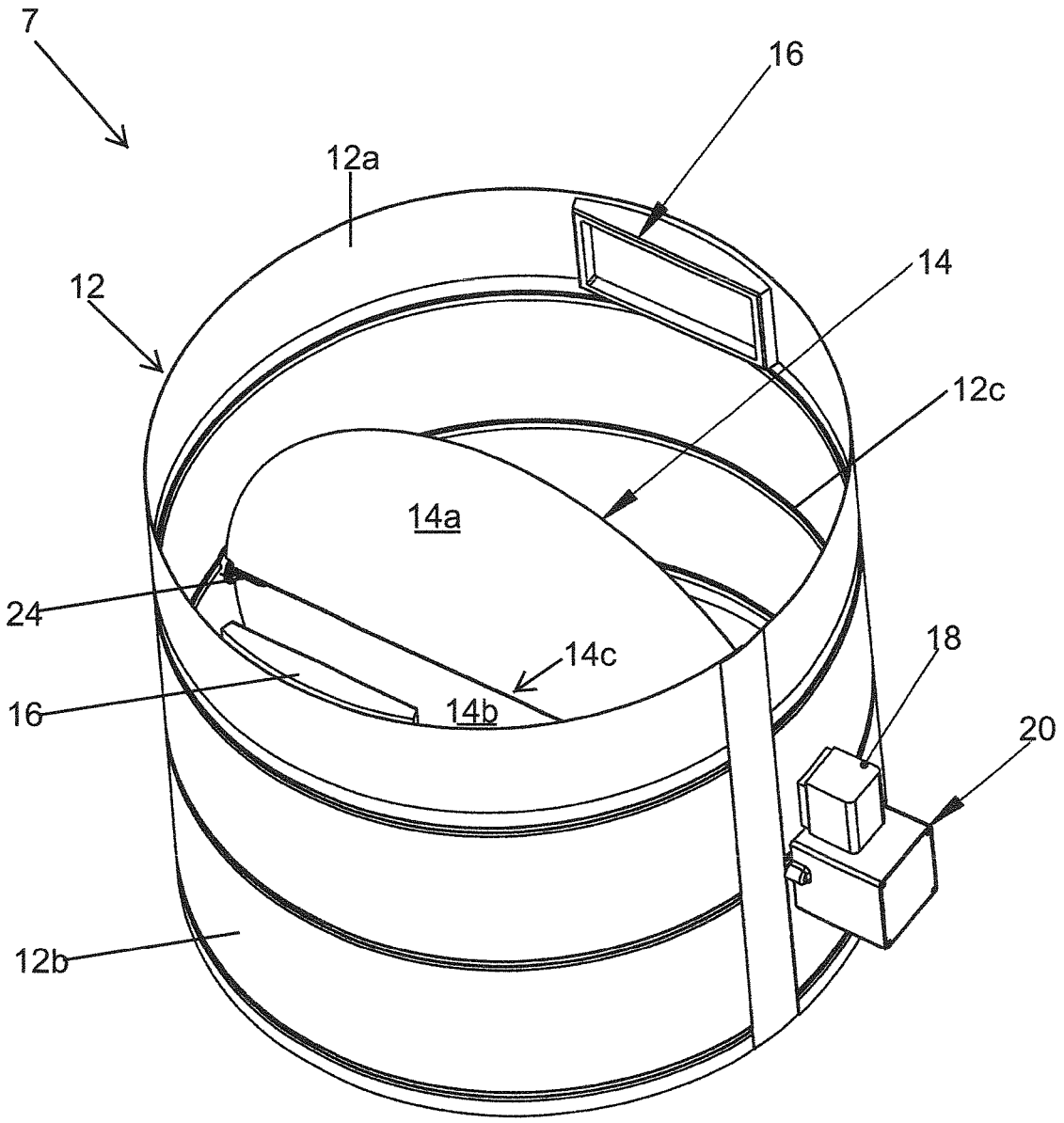
- FIG. 3 -

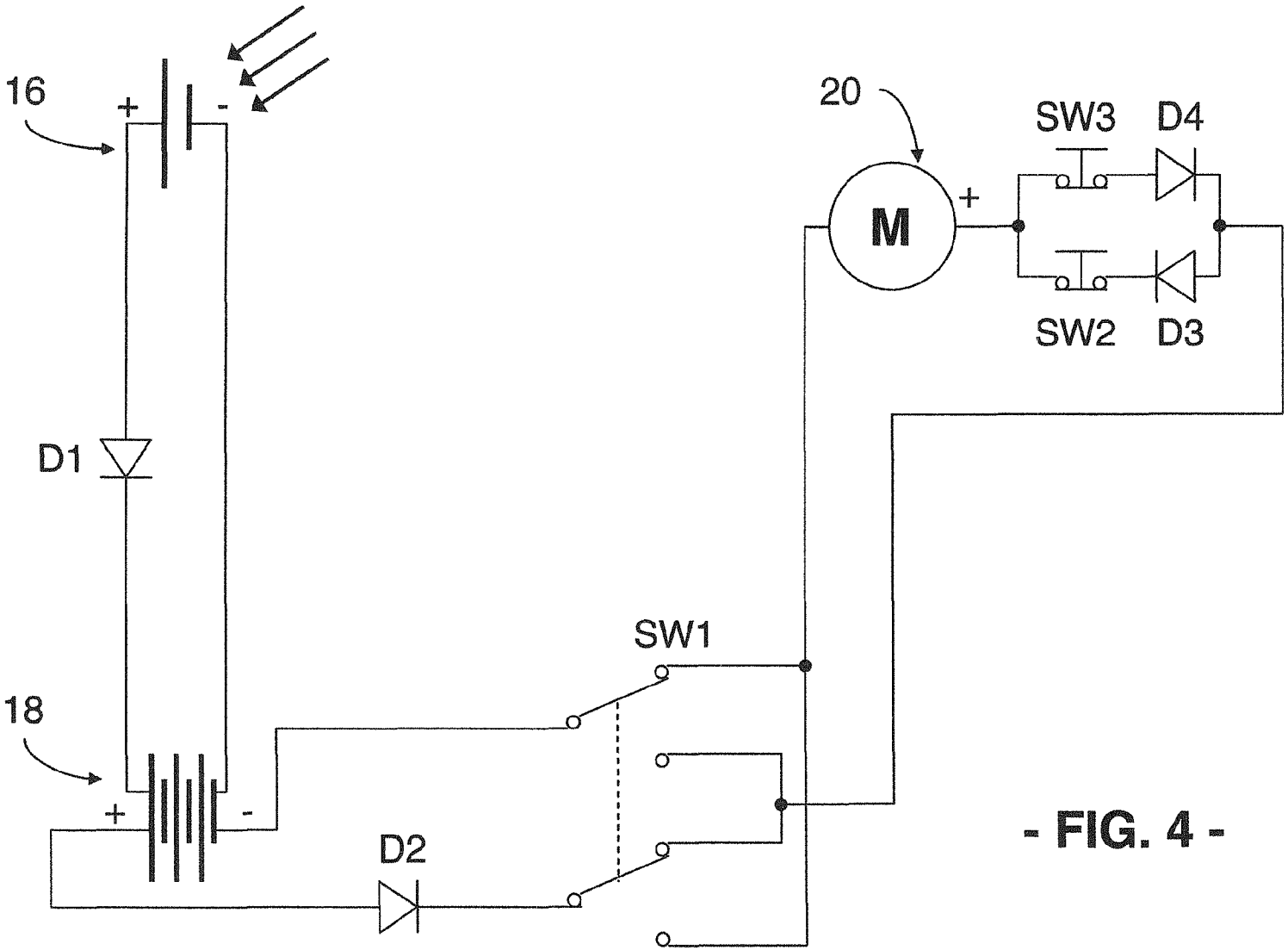
- FIG. 4 -

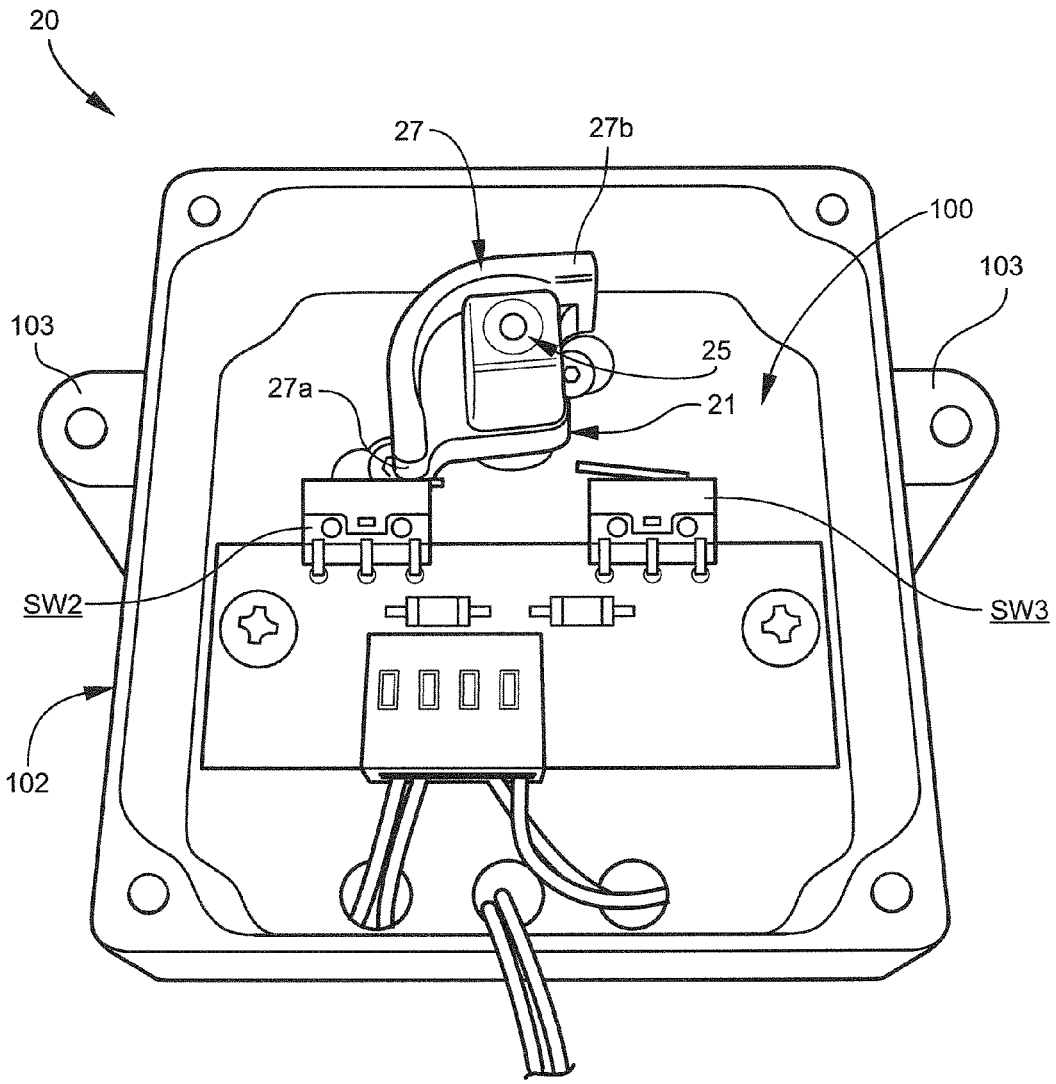
- FIG. 5 -

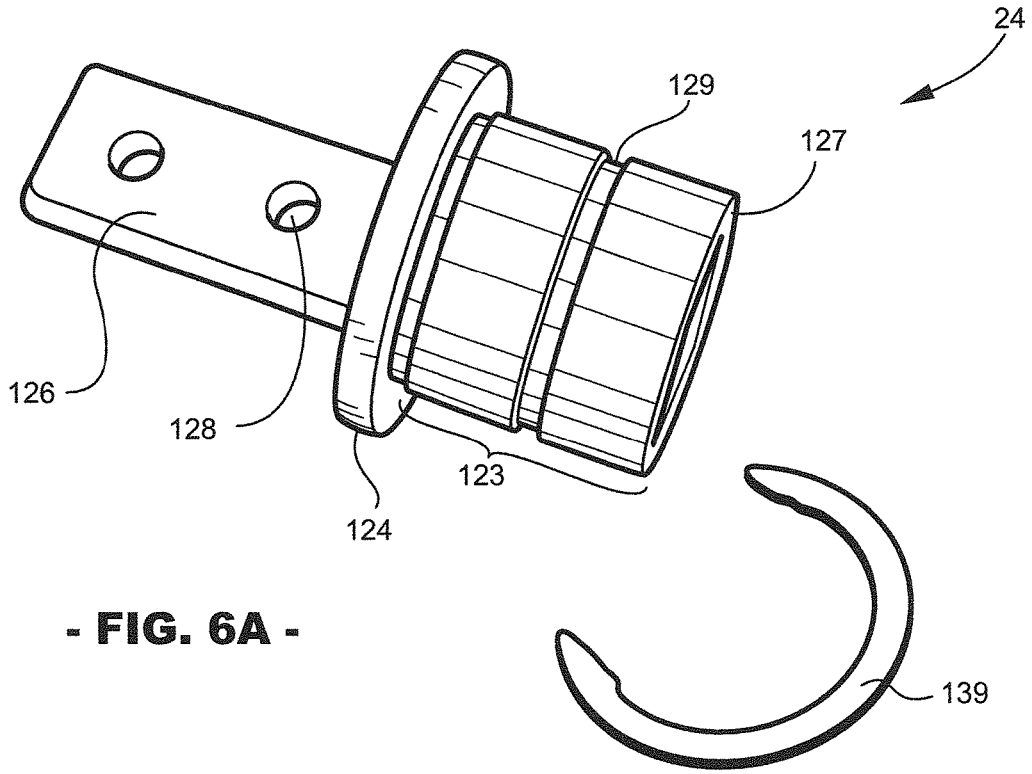
- FIG. 6A -
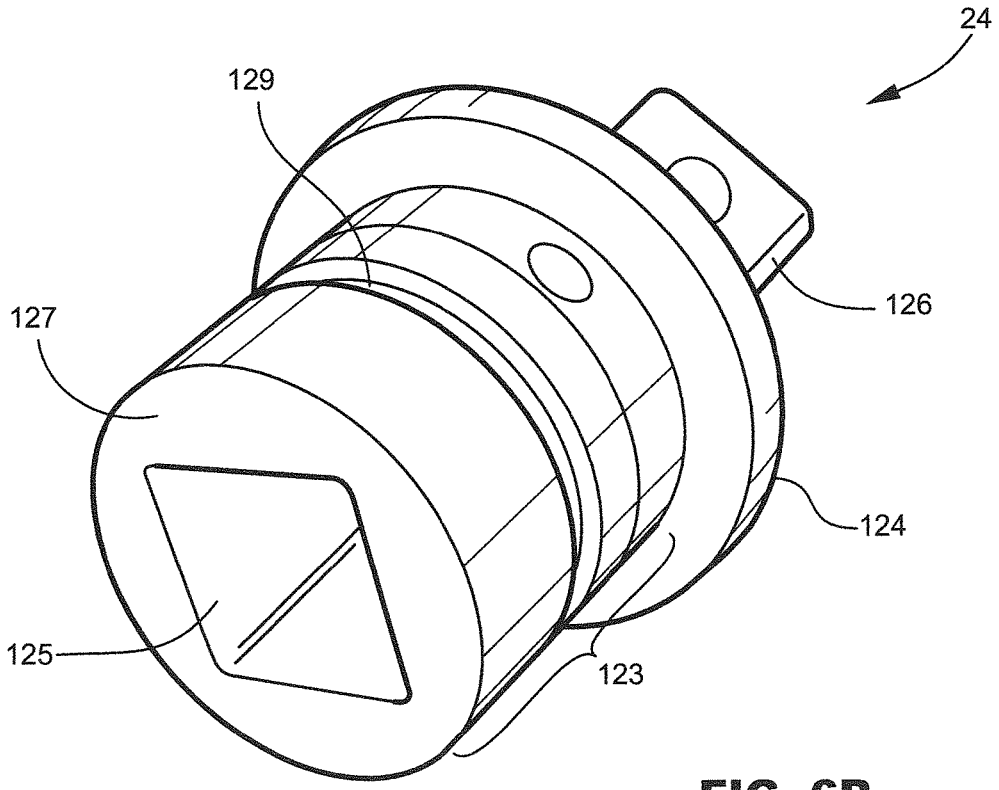
- FIG. 6B -

SOLAR-POWERED LIGHT DAMPER FOR TUBULAR SKYLIGHT

TECHNICAL FIELD

The present disclosure is directed to a light damper for a tubular skylight.

BACKGROUND

Skylights provide for the transmission of natural light to the interior of buildings. Popular both in commercial and residential structures, skylights provide a pleasing and desirable source of interior illumination and reduce the consumption and expense of electricity for lighting.

One especially useful type of skylight is a tubular skylight. A tubular skylight may include an exterior dome upon the roof of the building, an interior light diffuser at the interior building ceiling, and one or more light conveyors disposed between the dome and diffuser, such as light-conveying tubes.

In some configurations, tubular skylights may be purchased as pre-assembled systems, which make installation easier and which require less construction expertise. Tubular skylights also may be used without the need for reinforcing structural supports. In some applications, tubular skylights may require less complicated construction logistics than other types of skylights.

The light tubes used to convey light between the rooftop dome and the interior light diffuser may include a highly reflective interior surface that provides high efficiency light capture. Nevertheless, it may be desirable at times for some users to block light, in whole or in part, from being transmitted through the skylight, for example, to darken a room during daylight. Alternatively, sometimes it may be desirable to reduce the amount of light being transmitted through the skylight, by varying degrees for example, when the sun is at its brightest, without otherwise completely darkening the room.

U.S. Pat. No. 7,082,726 describes one approach for reducing light transmitted through a tubular skylight. The patentee therein sought to use a butterfly valve inserted into the light tube, the butterfly valve having two semicircular elements rotating about parallel axes toward one another (to open the valve and permit light transmittance) and away from one another (to close the valve and block light transmittance). Unfortunately, the light-damper system disclosed by this reference is complicated and expensive to manufacture and to install, requiring an electrician to install the wiring for the motor, and, having multiple parts, is more prone to failure.

Accordingly, what is needed is a light damper for a tubular skylight that is easy to manufacture, easy to install, reliable in use, and simple and efficient in construction. Further, a solar-powered light damper unit is desirable to reduce operational costs.

SUMMARY

A tubular skylight is provided with a solar-powered light damper unit that includes a damper supported by an axle within a light-conveying structure, at least one solar cell carried by the system, and a motor assembly. The system may include a cam in mechanical communication with the motor, connected to the axle and configured to rotate the damper to a fully open position, a fully closed position, or any intermediate position therebetween. The damper unit may be operated by a remote control. To prevent damage from inclement weather, incidental contact, or other perils, the solar cell may be housed within the skylight assembly. In particular, the solar cell may be attached to the damper itself or to an interior surface of a light-conveying structure (such as a light tube or a damper tube). The unit may be provided with new skylight installations or may be sold separately for use in retro-fitting existing installations.

A tubular skylight is provided herein that has a roof-top element, an interior light diffuser, at least one light-conveying structure having an interior surface and positioned between the roof-top element and the interior light diffuser, and a light damper for controlling the amount of light conveyed through the interior light diffuser. The light damper may include: a first panel, a second panel, and a shoulder connecting, rigidly or not, the first panel and the second panel, such that the first and second panels may reside in different planes; an axle affixed to the shoulder of the light damper, the axle securing the light damper within the light-conveying structure and providing an axis of rotation for the light damper; a solar cell attached to one of the light damper and the interior surface of the light-conveying structure; and a motor assembly including a motor and a cam rotated by the motor, the cam being operably connected with the axle of the light damper for rotating the light damper.

According to one aspect, the light-conveying structure may be in the form of a separable damper tube, within which the damper either is pre-installed or is installed later. The damper tube may define a circular cross-section with an interior diameter and a shoulder that defines a length approximating the interior diameter. The damper tube further may be provided with an inwardly projecting lip that circumscribes at least a portion of the interior surface of the damper tube and may define an upper surface and a lower surface. With such a configuration, when the light damper is closed, the first panel of the damper may be configured to contact the upper surface of the lip and the second panel of the damper may be configured to contact the lower surface of the damper, such configuration provided to prevent light seepage between the edges of the damper and the tube.

According to another aspect, two axles may be used to support the light damper, the axles being connected to the opposite ends of the shoulder to provide an axis of rotation for the damper. In this aspect, each axle may include a central flange in contact with the light-conveying structure, a trunk extending from one side of the central flange beyond the light-conveying structure, and a tongue extending from the flange opposite the trunk. The tongue may be connected to the shoulder of the light damper. The trunk may have a bottom surface defining an axle socket for securing the light damper within the light-conveying structure.

Further in this aspect, the axle socket of the first axle may be engaged with a cam of the motor. Additionally, the trunk of the second axle may define an annular groove and the light-conveying structure may define a trunk-receiving opening opposite the motor assembly through which the trunk of the second axle is positioned, such that the annular groove can be positioned beyond an exterior surface of the light-conveying structure. A C-shaped axle clip may be fitted into the annular groove to secure the second axle within the light-conveying structure.

In yet another aspect, a solar cell may be mounted to the light-conveying structure proximate the roof-top element, using a bracket to accomplish the mounting. Alternately, the cell may be mounted to the interior surface of the light-conveying structure beyond the rotational path of the damper or to the light damper directly, such that the cell is oriented upwardly toward the roof-top element when the damper is in a closed position. A plurality of solar cells may be mounted within the light-conveying structure.

The motor assembly may include a first switch and a second switch, and a cam moving between a first position in contact with the first switch and a second position in contact with the second switch. Further in this aspect, the cam may direct the movement of the light damper in a forward and backward rotation to a maximum terminal position of about 90 degrees relative to an imaginary horizontal plane through the center of the light damper tube, the maximum terminal position occurring when the cam contacts one of the switches.

The light damper unit may be operated by a remote control in wireless communication with the motor assembly.

A light damper according to the description herein is also provided.

BRIEF DESCRIPTION OF THE DRAWINGS

A full and detailed disclosure is set forth in the accompanying specification with reference to the appended figures, in which:

FIG. 1A is a perspective view of a tubular skylight installation, including a first light damper unit, according to the teachings herein, in which solar cells are attached beneath the roof-top element of the skylight;

FIG. 1B is an enlarged perspective view of the tubular skylight of FIG. 1A, showing the relative placement of solar cells;

FIG. 2A is a perspective view of another light damper unit, according to the teachings herein, in which a light damper is oriented in an open position and solar cells are attached directly to the light damper panels, and further illustrating an exemplary remote control for operating the light damper unit;

FIG. 2B is a perspective view of the light damper unit of FIG. 2A, in which the light damper is oriented in a closed position;

FIG. 3 is a perspective view of yet another light damper unit, according to further teachings herein, in which the light damper is oriented in an open position and solar cells are attached to interior of a separable light damper tube;

FIG. 4 is a schematic illustration of an electrical system used with the light damper units described herein;

FIG. 5 is a perspective view of a motor assembly used with the light damper units described herein;

FIG. 6A is a side perspective view of an axle and an axle clip used in conjunction with the present light damper units; and FIG. 6B is a perspective view of the axle of FIG. 6A, as seen from an end thereof.

DETAILED DESCRIPTION

Reference is now made to the drawings for illustration of various components of the present light damper units for a tubular skylight.

The skylight may have any cross-sectional shape, including a generally circular cross-sectional shape defined by light-transmitting structures extending between a roof of a building and an interior ceiling. While the particular illustrations provided herein are directed to a particular tubular skylight having telescoping light tubes and a dome-shaped roof-top covering element, various elements and embodiments may be applicable to tubular skylights having other features or mechanisms (including a rectangular roof opening).

FIGS. 1A and 1B illustrate a tubular skylight assembly 200 installed on a roof top 201, for example a commercial or residential building. The skylight assembly 200, which may be mounted on a roof-top curb 268, may include a light-transmitting roof-top element 270, an (optional) elbow joint 264, at least one light-conveying structure, such as tube 260 (also light tube 262), a displacement absorber 250, and an interior light diffuser 246. A light damper unit 3, as described herein, may be positioned between the light tube 260 and the light diffuser 246, although the light damper unit 3 may be positioned elsewhere along the path of light within the assembly 200. Alternatively, the damper unit 3 may be incorporated within the light tube 260 (or 262) as an integral part of the light-conveying structure; that is, the light tube 260 (or 262) may replace the damper tube (12, as seen in FIG. 2A) by securing the damper components, such as damper 14, solar cells 16, and motor assembly 20, to the light tube 260 (or 262).

The roof-top covering element 270 may be transparent or translucent, and may be dome-shaped, curvilinear, flat, or of other configurations as needs or preferences may dictate or suggest. A light-conveying structure, such as paired tubes 260, 262, may be provided in a telescoping configuration; that is, one of the tubes 260, 262 may be slidably disposed within the other to facilitate shipping and installation. Alternatively, a single light tube (e.g., 260) may be used, depending on the distance the skylight assembly 200 must span between the roof top 201 and the ceiling (not shown) of an interior room to be illuminated.

The interior light diffuser 246 may be circular in shape, corresponding to the diameter of the light tube (e.g., 260) and the light damper unit 3. In some circumstances, a square or rectangular shaped skylight opening may be preferred, for example in rooms for which the skylight installation replaces one or more rectangular ceiling tiles. Further, apertures in ceilings constructed of plasterboard or the like may be more easily cut with a rectangular geometry than with a circular geometry. In these instances, an adaptor 248 may be provided between the light damper unit 3 (or the light tube 260) and the light diffuser 246 to accommodate the desire for a rectangular skylight opening. The light diffuser 246 may define the shape of the skylight opening visible to building occupants and the adaptor 248 may provide a transition between the generally tubular shape of the light-conveying structures (e.g., 260, 262) and the diffuser 246.

The interior surfaces of the light tubes 260, 262, the light damper unit 3, and the adaptor 248 may be highly reflective to ensure that the light entering the covering element 270 may be efficiently transmitted into the building interior. By way of example, the light tubes 260, 262, light damper unit 3 (particularly damper tube 12), and the adaptor 248 may be made of aluminum, which can be lightweight as well as highly reflective. Alternately, or in addition, the interior surfaces of the light conveying elements (e.g., light tubes 260, 262, damper tube 12, and adaptor 248) may be polished or treated with coatings or films to enhance the reflectivity of light within such structures.

While ordinarily advantageous, the high degree of efficiency with which light may be conveyed into the chosen interior room may be problematic under certain conditions, making the present damper unit 3 (also 5 and 7) useful. For example, it may be desirable to darken a room during daylight hours for many reasons, such as daylight napping or television viewing, for video presentations in office, school, or other settings, or for other reasons. Also, at night, the light-reflecting nature of the skylight assembly may tend to reflect interior light upward through the skylight covering element 270, which may undesirably attract light-seeking nighttime insects. The present light damper unit 3 (also 5 and 7)

addresses these issues by providing users with the ability to control the amount of light flowing into (or out of) a building interior.

The light damper unit 3 (also 5, 7) may employ a power source for operation. To this end, the skylight assembly 200 may be provided with one or more solar cells 16 that convert sunlight into electricity that may be carried by wires W to a battery 18 and then to a motor assembly 20 (shown in FIG. 2A). The solar cells 16 may be positioned within the interior of the skylight assembly 200, either near the roof-top element 270 (as shown in FIGS. 1A and 1B, resulting in the light damper unit 3), or on the light damper itself (as shown in FIGS. 2A and 2B, resulting in the light damper unit 5), or within the interior of the light damper tube (as shown in FIG. 3, resulting in the light damper unit 7). Another option (not shown) may involve the attachment of the solar cells 16 within one of the light-conveying structures (e.g., 260 or 262), which may be useful in certain installations, such as that in which the damper 14 is installed directly within one of the light-conveying structures (e.g., 260 or 262). Each of these configurations can offer the benefit of housing the solar cells 16 within the skylight assembly 200 itself, thus protecting the cells 16 from damage resulting from environmental stresses or other risks.

The configuration of FIGS. 1A and 1B may result in the solar cells 16 being mounted on brackets 56, such that the brackets 56 support the solar cells 16 within the light-conveying tube (e.g., 264). The brackets 56 may be positioned along the perimeter of the assembly 200, oriented inwardly, such that the photovoltaic sells 16 may be housed within the assembly 200 but do not significantly impede light from being conveyed through the light tubes 260, 262.

The light damper unit 3 may include the same components as the light damper units 5 and 7 and, therefore, is not separately illustrated or described. As mentioned previously, a difference between the three exemplary light damper units is the location of the solar cells 16. Thus, the discussion of the various components of the light damper units illustrated in FIGS. 2A-6B applies to light damper unit 3 as well as light damper units 5 and 7.

FIG. 2A illustrates a light damper unit 5 for inclusion in a tubular skylight (e.g., 200, as shown in FIG. 1A). As illustrated, the light damper unit 5 may be provided with a damper tube, or housing, 12, a light damper 14 secured within the damper tube 12 by at least one axle 24, at least one solar cell 16, and a motor assembly 20 in mechanical engagement with the axle 24 for rotating the damper 14. Alternately, the damper tube 12 may be omitted, and the remaining components may be installed within or on one of the light-conveying structures 260, 262. A battery 18 may also be provided for storing electricity from the solar cells 16 and providing electricity to the motor assembly 20.

The damper tube 12 includes a light-reflecting interior surface 12*a* and an exterior surface 12*b* opposite the interior surface 12*a*. The damper tube 12 may further include an inwardly projecting lip 12*c* that may be integral with the damper tube 12 and that circumscribes its interior surface 12*a*. The inwardly projecting lip 12*c* can be generally U-shaped, having an upper surface and a lower surface. When the light damper unit 5 is in a fully closed configuration, the damper panels 14*a*, 14*b* (described below) may contact the upper and lower surfaces of the lip 12*c*, respectively, to better seal the light passageway and to prevent light leakage around the damper 14. As shown in FIG. 2B, the damper panel 14*a* contacts and covers the upper surface of the lip 12*c*, while the damper panel 14*b* contacts the lower surface of the lip 12*c*.

In the event that the damper 14 is installed directly within a light tube 260 (or 262), the light tube 260 (or 262) may be crimped to create the U-shaped lip (12*c*) described above, the crimped portion being located at the area desired for placement of the damper 14. While the use of a separate damper tube 12 permits the damper unit (e.g., 5) to be used for retrofitting existing tubular skylights, there may be instances in which the installation of the damper 14 directly within a light tube (e.g., 260), as provided by the manufacturer, is desirable.

The light damper 14 may be a rotatable member having a first panel 14*a* and a second panel 14*b*, which may be connected by a shoulder 14*c* such that the first and second panels 14*a*, 14*b* may reside in different planes. In one aspect, the panels 14*a*, 14*b* may reside in different planes, for example parallel planes. The light damper 14 may be formed as a single piece of stamped aluminum or some other material. The length of the shoulder 14*c* may approximate the interior diameter of the damper tube 12 for full coverage. The first and second panels 14*a*, 14*b* may be sized and shaped (e.g., as semicircular panels) to block light from most of the interior surface area of the light damper tube 12 and to abut the surfaces of the lip 12*c* to prevent light from leaking past the damper 14.

The light damper 14 may be held within the light damper tube 12 (or, alternately, a light conveying structure, such as tube 260) by at least one axle 24 that serves as an axis of rotation for the damper 14. A single axle 24 may be used across the length of the damper 14, being connected to the shoulder 12*c* at opposite ends thereof by rivets, screws, bolts, welding, gluing, or other attachment means. Alternately, as shown in FIGS. 3, 6A, and 6B, two shorter axles 24 may be used, each being attached at a respective end of the shoulder 12*c* using one or more of the attachment means listed above.

In one aspect shown in FIGS. 2A and 2B, solar cells 16 (that is, photovoltaic cells used as a power source) may be secured to a surface of the light damper 14 itself. Although two cells 16 are shown with a single cell 16 being secured to each of the damper panels 14*a*, 14*b*, other numbers and sizes of cells may instead be used, including the use of a damper upon which one or more solar panels cover the entire surface 14. When the damper 14 is in the closed position, as in FIG. 2B, the solar cells 16 may be oriented in an upward-facing direction toward the light source, such that light being transmitted through the skylight may be captured by the solar cells 16. Even when the damper 14 is in a fully open position, the solar cells 16 are still able to capture light that may be reflected at various angles between the interior surfaces of the light-transmitting tubes. The solar cells 16 convert light to electricity by photoelectric effect, and wiring W (shown in FIGS. 1A and 1B) may transmit electricity from the solar cells 16 to the battery 18 attached to the exterior surface 12*b* of the damper tube 12. The solar cells 16 may be made of any material or type capable of functioning in the prescribed manner.

The battery 18 can store electricity from the solar cells 16 and may convey electricity by wiring (not shown) to power the motor assembly 20. While the battery 18 is shown as being located proximate to the motor 20, the battery 18 may be located in some other position. Further, although a single battery 18 is illustrated, the number of batteries may vary and may, in some embodiments, correspond to the number of solar cells 16, with each battery being wired individually to the motor assembly 20.

A user may operate the motor assembly 20 with a wall-mounted switch or a remote control 80 to achieve the desired position of the light damper 14 and the corresponding amount of light being transmitted into a room. The remote control 80 may be a handheld, battery-operated device that uses infrared signals to communicate to the motor assembly 20.

A representative remote control 80 is also shown in FIG. 2A, in which the remote control 80 may be provided with three buttons 80*a*, 80*b*, and 80*c* that control the operation of the damper unit 5 (or 3 or 7). By way of example, pushing button 80*a* may cause the damper 14 to open fully, while pushing button 80*c* may cause the damper 14 to close fully. The button 80*b* may cause the motor to stop in an intermediate position between fully open and fully closed, thereby permitting the user to obtain a desired level of light transmission. Other numbers of buttons and different functionality may instead be used, if so desired. An exemplary operating mechanism of the motor assembly 20 is discussed herein with reference to FIG. 4.

FIG. 3 depicts yet another possible configuration of a self-contained light damper unit 7, in which the light damper 14 is oriented in an open position and the solar cells 16 may be placed along the interior walls 12*a* of the damper tube 12 beyond the rotational path of the light damper 14. As illustrated, the solar cells 16 may be located opposite one another in positions generally parallel to the rotational axis of the light damper 14. Alternately, an array of solar cells 16 may be positioned along the interior surface 12*a* of the damper tube 12. In instances in which the damper 14 is installed directly within a light tube (e.g., 260), the solar cells 16 may be secured to the interior surface of the light tube 260 itself.

As in FIG. 2A, wiring (not shown in this view) may connect the solar cells 16 to the battery 18, and the battery 18 to the motor assembly 20. The axle 24 opposite the motor assembly 20 may be installed within an opening 143 in the damper tube 12, as will be discussed further below.

A representative electrical schematic diagram is shown in FIG. 4, illustrating one embodiment. According to such an embodiment, electricity may flow from the solar cell(s) 16 to the battery 18. A diode D1 positioned between the solar cell 16 and the battery 18 prevents the battery 18 from discharging electricity into the solar cell 16, thus resulting in a one-way communication between the solar cell 16 and the battery 18. Electricity flows from the battery 18 through a double pole-double throw (DPDT) switch SW1 to the motor assembly 20. A second diode D2 may be included between the battery 18 and the switch SW1. The battery 18 powers the motor assembly 20.

The motor assembly 20 may include a motor M (also indicated as 100, in FIG. 5) and a pair of switches (SW2 and SW3) that can define the range of motion of the light damper 14. The switches SW2 and SW3 may be further connected to diodes D3 and D4, respectively.

As shown in FIG. 5, the motor 100 may be provided with a motor housing 102 and a rotatable cam 21. An exemplary motor 100 may be a 6-volt electrical motor. The cam 21 may have a centrally located cam shaft 25 that may be positioned over and engaged with a shaft (not shown) projecting from the motor 100. The cam shaft 25 may have a square profile, although a different shape may be used, the cam shaft 25 itself being engaged by a correspondingly shaped axle socket (125) formed in the bottom surface of the axle 24 (the socket 125 being shown most clearly in FIG. 6B).

Surrounding the square profile of the cam shaft 25 on two adjacent sides may be an arc-shaped member 27 with terminal ends 27*a*, 27*b*. A first terminal end 27*a* may be moved in a forward direction into contact with the switch SW2, thus signifying a first endpoint of the path of travel of the light damper (14). By way of example, the first endpoint may correspond to a fully closed damper position, in which the damper panel 14*a* may be carried downward and into contact with the upper surface of the inwardly projecting lip 12*c* and the damper panel 14*b* may be carried upward and into contact with the bottom surface of the inwardly projecting lip 12*c*. At this point, the cam 21 may be moved in a reverse direction, continuing (if desired) to a second endpoint of the path of travel of the light damper (14), culminating when the second terminal end 27*b* of the arc-shaped member 27 contacts the switch SW3. The second endpoint corresponds to a fully open damper position, in which the damper 14 may be positioned at a maximum terminal position about ninety (90) degrees from the fully closed damper position. At any intermediate position between the two endpoints, an operator of the light damper unit (3, 5, or 7) may choose to terminate power to the motor assembly 20, causing the light damper 14 to be held in an orientation between such two positions.

The light damper 14 may rotate about a single axle or about a pair of oppositely disposed axles installed on each end of the shoulder 14*c*. FIGS. 6A and 6B illustrate one of the oppositely disposed light damper axles, or pivots, 24 used to secure the light damper (14) within the damper tube 12 (or, alternately, a light-conveying tube). The damper axle 24 may include a central flange 124 from which a flat tongue 126 projects on one side. The flat tongue 126 may define therethrough a pair of apertures 128 for securing the damper axle 24 to the shoulder 14*c* of the light damper 14.

A cylindrical trunk 123 may project from the central flange 124 opposite the flat tongue 126 and through a corresponding trunk-receiving aperture in the light-conveying structure (260 or 262) or the damper tube (12). The trunk 123 may terminate in a bottom surface 127, having a square-shaped socket 125 therein. In the case of the axle 24 located adjacent the motor assembly 20, the socket 125 may receive the cam shaft (25) for transferring rotational movement from the cam 21 to the damper (14). The cam shaft 25 and the axle socket 125 may be of a shape other than square, provided their shapes correspond for engagement with one another.

Between the flange 124 and the bottom surface 127, the trunk 123 may include an annular groove 129. In the case of the axle 24 located opposite the motor assembly 20, the trunk portion 123 of the axle 24 may be positioned through a correspondingly sized trunk-receiving opening in the damper tube 12, such that the annular groove 129 can be positioned beyond the exterior surface 12*b* of the damper tube 12. To hold the axle 24 in place, a C-shaped axle clip 139 may be fitted over and into the annular groove 129 on the exterior of the damper tube 12.

When a single axle is used instead of oppositely disposed axles, the single axle may span the length of the shoulder 14*c* (as shown in FIG. 2B). In this case, the opposite ends of the axle may be configured, as described above, for attachment to the light-conveying structure (damper tube 12 or light tube 260) and to the motor assembly 20. The axle 24 may be attached to the shoulder 14*c* of the damper 14 using screws, rivets, bolts, welding, adhesive, combinations thereof, or any other attachment means.

The preceding discussion illustrates the principles of the present light damper unit and operating system. As provided herein, the damper may be installed as a separable unit for attachment to a light-conveying tube of a skylight, making it well-suited for retro-fitting existing skylight installations in addition to manufacturing new skylight constructions. The unitary design, provided in one aspect of the disclosure, permits simple connection between the skylight tube and the damper tube (for example, using bolts or rivets), and the use of solar energy to operate the motor assembly decreases the need for an electrician. Moreover, the same principles of operation may be applied to construct a skylight in which the damper component is manufactured or installed integrally within one of the light-conveying structures of the skylight.

It will be appreciated that those skilled in the art may be able to devise various arrangements, which, although not explicitly described or shown herein, embody the principles of the invention and are included within its spirit and scope. Furthermore, all examples and conditional language recited herein are expressly intended to be for educational purposes only and to aid the reader in understanding the principles of the inventions and the concepts contributed by the inventor(s) to furthering the art and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawings, which are to be considered part of the entire description of the invention. In the description, relative terms such as "lower", "upper", "horizontal", "vertical", "above", "below", "up", "down", "top" and "bottom", as well as derivatives thereof (e.g., "horizontally", "downwardly", etc.) should be construed to refer to the orientation as then described or as shown in the drawing under discussion. These relative terms are for convenience of description and do not require that the apparatus be constructed or operated in a particular orientation, unless otherwise indicated. Terms concerning attachment, coupling, and the like, such as "connected", "attached", or "interconnected", refer to a relationship wherein structures are secured or attached to one another either directly or indirectly through intervening structures, unless expressly described otherwise.

We claim:

1. A tubular skylight having a roof-top element, an interior light diffuser, at least one light-conveying structure having an interior surface and being positioned between the roof-top element and the interior light diffuser, and a light damper for controlling the amount of light conveyed through the interior light diffuser, the light damper comprising:

a first panel, a second panel, and a shoulder connecting the first panel and the second panel, the first and second panels residing in different planes;

the light damper further comprising an axle affixed to the shoulder, the axle securing the light damper within the light-conveying structure and defining an axis of rotation for the light damper;

a motor connected with the axle of the light damper and adapted to rotate the light damper; and a photovoltaic cell attached to at least one of the light damper and the interior surface of the light conveying structure, the photovoltaic cell configured to generate power for the motor.

2. The tubular skylight of claim 1, wherein the light-conveying structure comprises a separable damper tube, the light damper being installed within the damper tube.

3. The tubular skylight of claim 2, wherein the damper tube defines a circular cross-section with an interior diameter and wherein the shoulder has a length approximating the interior diameter of the damper tube.

4. The tubular skylight of claim 3, wherein the damper tube includes an inwardly projecting lip, the lip circumscribing at least a portion of the interior surface of the damper tube and defining an upper surface and a lower surface, the first semicircular panel contacting the upper surface and the second semicircular panel contacting the lower surface when the damper is in a closed position.

5. The tubular skylight of claim 1, further comprising a first axle and a second axle, the first and second axles connected to opposite ends of the shoulder of the light damper and configured to secure the light damper within the light-conveying structure and further configured to provide an axis of rotation for the light damper.

6. The tubular skylight of claim 5, wherein each of the first and second axles includes a central flange in contact with the light-conveying structure; a trunk extending from one side of the flange beyond the light-conveying structure; and a tongue extending from the flange opposite the trunk, the tongue being connected to the shoulder of the light damper, and the trunk having a bottom surface defining an axle socket for securing the light damper within the light-conveying structure.

7. The tubular skylight of claim 5, wherein the axle socket of the first axle is engaged with the cam of the motor.

8. The tubular skylight of claim 5, the light-conveying structure including an exterior surface, wherein the trunk of the second axle defines an annular groove and the light-conveying structure defines a trunk-receiving opening opposite the motor assembly, the trunk of the second axle being positioned through the trunk-receiving opening in the light-conveying structure such that the annular groove is disposed beyond an exterior surface of the light-conveying structure.

9. The tubular skylight of claim 8, further comprising a C-shaped axle clip, the axle clip being fitted into the annular groove in the trunk of the second axle to secure the second axle.

10. The tubular skylight of claim 1, further comprising a bracket mounted to the light-conveying structure proximate the roof-top covering element, the bracket disposed to support the solar cell within the light-conveying structure.

11. The tubular skylight of claim 1, wherein the solar cell is mounted to the interior surface of the light-conveying structure beyond the rotational path of the light damper.

12. The tubular skylight of claim 1, wherein the solar cell is mounted directly to the light damper such that, when the damper is in a closed position, the solar cell is oriented toward the roof-top element.

13. The tubular skylight of claim 1, comprising a plurality of solar cells carried by the interior surface of the light-conveying structure.

14. The tubular skylight of claim 1, wherein the motor includes a first switch and a second switch, the cam moving between a first position in contact with the first switch and a second position in contact with the second switch.

15. The tubular skylight of claim 14, wherein the movement of the cam directs the light damper, the light damper movable with a forward and backward rotation to a maximum terminal position of about 90 degrees, the maximum terminal position occurring when the cam contacts one of the first and second switches.

16. The tubular skylight of claim 14, further comprising a remote control, the remote control being in wireless communication with the motor assembly.

17. A light damper for a tubular skylight, the light damper being rotatably positioned within a light-conveying structure having a light-reflecting interior surface and an exterior surface opposite the interior surface, the light damper comprising:

a first panel, a second panel, and a shoulder rigidly connecting the first panel and the second panel, such that the first and second semicircular panels are positioned on different planes;

the light damper further comprising an axle affixed to the shoulder, the axle securing the light damper within the light-conveying structure and defining an axis of rotation for the light damper;

a motor connected with the axle of the light damper and adapted to rotate the light damper; and a photovoltaic cell attached to at least one of the light damper and the interior surface of the light conveying structure, the photovoltaic cell configured to generate power for the motor.

18. The light damper unit of claim 17, wherein the light-conveying structure defines an interior diameter and an inwardly projecting lip, the lip circumscribing at least a portion of the interior surface of the light-conveying structure; wherein the shoulder of the light damper has a length approximating the interior diameter of the light-conveying structure; and wherein the first and the second panels each define a semicircular shape and contact the lip when the damper is in a closed position.

19. The light damper unit of claim 17, further comprising a first axle and a second axle, the first and second axles being connected to opposite ends of the shoulder of the light damper; wherein each axle has a central flange, a trunk extending from one side of the flange, and a tongue extending from the flange opposite the trunk, the tongue being connected to the shoulder; wherein the trunk of the first axle has a bottom surface defining an axle socket, the axle socket engaging the cam of the motor assembly; and wherein the trunk of the second axle defines an annular groove and the damper tube defines a trunk-receiving opening opposite the motor assembly, the trunk of the second axle being positioned through the trunk-receiving opening in the light-conveying structure, such that the annular groove is positioned beyond the exterior surface of the light-conveying structure.

20. The light damper unit of claim 19, further comprising a C-shaped axle clip, the axle clip being fitted into the annular groove in the trunk of the second axle to secure the second axle.

21. The light damper unit of claim 17, wherein the motor assembly includes a first switch and a second switch, the cam moving being a first position in contact with the first switch and a second position in contact with the second switch; and wherein the light damper exhibits a forward and backward rotation to a maximum terminal position of about 90 degrees, the maximum terminal position occurring when the cam contacts one of the first and second switches.

* * * * *